US010227727B2

(12) United States Patent
Padilla et al.

(10) Patent No.: US 10,227,727 B2
(45) **Date of Patent: *Mar. 12, 2019**

(54) ROPE HAVING A LOW-FRICTION STRAND

(71) Applicant: Actuant Corporation, Menomonee Falls, WI (US)

(72) Inventors: Luis S. Padilla, Davidson, NC (US); Philip Samuel Bull, Shropshire (GB); Randy S. Longerich, Bellingham, WA (US); Aaron M. Vodnick, Warwick, RI (US)

(73) Assignee: Actuant Corporation, Menomonee Falls, WI (US)

( * ) Notice: Subject to any disclaimer, the term of this patent is extended or adjusted under 35 U.S.C. 154(b) by 690 days.

This patent is subject to a terminal disclaimer.

(21) Appl. No.: 14/760,961

(22) PCT Filed: Jan. 14, 2014

(86) PCT No.: PCT/US2014/011545

§ 371 (c)(1),
(2) Date: Jul. 14, 2015

(87) PCT Pub. No.: WO2014/110599

PCT Pub. Date: Jul. 17, 2014

(65) Prior Publication Data

US 2015/0354136 A1 Dec. 10, 2015

Related U.S. Application Data

(60) Provisional application No. 61/752,195, filed on Jan. 14, 2013.

(51) Int. Cl.
*D07B 1/04* (2006.01)
*D07B 7/02* (2006.01)
(Continued)

(52) U.S. Cl.
CPC ..... *D07B 1/04* (2013.01); *D04C 1/12* (2013.01); *D07B 1/025* (2013.01); *D07B 7/02* (2013.01);
(Continued)

(58) Field of Classification Search
CPC ..... D07B 1/025; D07B 1/04; D04C 1/12
See application file for complete search history.

(56) References Cited

U.S. PATENT DOCUMENTS 3,402,547 A 9/1968 Parsey
3,699,768 A 10/1972 Roberts et al.
(Continued)

FOREIGN PATENT DOCUMENTS

CN 1625618 6/2005
CN 101115873 1/2008
(Continued)

OTHER PUBLICATIONS

Second Office Action from The State Intellectual Property Office of the People's Republic of China for Application No. 201480012972.0 dated May 17, 2017 (9 pages).
(Continued)

*Primary Examiner* — Shaun R Hurley
(74) *Attorney, Agent, or Firm* — Michael Best & Friedrich LLP

(57) ABSTRACT

A rope and a method of constructing the rope. The rope may be of 12×12 braided construction and include a core for its length. The rope includes a plurality of primary strands, and each of the primary strands includes a plurality of fibers which may be made of a high-friction material. The rope also includes a secondary strand surrounded by the plurality of primary strands. The secondary strand includes a plurality of fibers which may be made of a low-friction material.

20 Claims, 7 Drawing Sheets

(51) Int. Cl.
*D04C 1/12* (2006.01)
*D07B 1/02* (2006.01)

(52) U.S. Cl.
CPC ..... *D07B 2201/102* (2013.01); *D07B 2201/1012* (2013.01); *D07B 2201/1014* (2015.07); *D07B 2201/1024* (2013.01); *D07B 2201/1096* (2013.01); *D07B 2201/2036* (2013.01); *D07B 2201/2044* (2013.01); *D07B 2201/2055* (2013.01); *D07B 2201/2057* (2013.01); *D07B 2201/2066* (2013.01); *D07B 2201/2067* (2013.01); *D07B 2205/205* (2013.01); *D07B 2205/2014* (2013.01); *D07B 2205/2042* (2013.01); *D07B 2205/2064* (2013.01); *D07B 2205/2071* (2013.01); *D07B 2401/207* (2013.01)

(56) References Cited

U.S. PATENT DOCUMENTS

| | | | | |
|---|---|---|---|---|
| 3,791,658 | A | 2/1974 | Zumeta et al. | |
| 4,120,145 | A | 10/1978 | Chiappetta et al. | |
| 4,270,341 | A | 6/1981 | Glushko et al. | |
| 5,067,384 | A | 11/1991 | Scala | |
| 6,945,153 | B2 | 9/2005 | Knudsen et al. | |
| 7,036,298 | B2 | 5/2006 | Honda | |
| 7,047,860 | B2 | 5/2006 | Faborsky | |
| 7,168,231 | B1 | 1/2007 | Chou et al. | |
| 7,296,394 | B2 | 11/2007 | Clough et al. | |
| 7,409,815 | B2 | 8/2008 | Clough et al. | |
| 7,823,496 | B2 | 11/2010 | Bosman et al. | |
| 8,020,480 | B2 | 9/2011 | Magner | |
| 9,976,251 | B2 * | 5/2018 | Padilla | D04C 1/12 |
| 2004/0069132 | A1 | 4/2004 | Knudsen et al. | |
| 2005/0069703 | A1 | 3/2005 | He et al. | |
| 2005/0288775 | A1 | 12/2005 | Dong | |
| 2006/0155328 | A1 * | 7/2006 | Foerster | A61B 17/06166 606/228 |
| 2006/0179812 | A1 | 8/2006 | Clough et al. | |
| 2006/0182962 | A1 | 8/2006 | Bucher et al. | |
| 2006/0207414 | A1 | 9/2006 | Nye | |
| 2006/0213175 | A1 | 9/2006 | Smith et al. | |
| 2007/0062174 | A1 | 3/2007 | Clough et al. | |
| 2007/0202329 | A1 | 8/2007 | Davis et al. | |
| 2009/0078922 | A1 | 3/2009 | Kempf et al. | |
| 2009/0165637 | A1 | 7/2009 | Bosman et al. | |
| 2009/0245941 | A1 | 10/2009 | Magner | |
| 2012/0067020 | A1 | 3/2012 | Paddock et al. | |
| 2012/0297746 | A1 | 11/2012 | Chou et al. | |
| 2014/0196596 | A1 * | 7/2014 | Padilla | D04C 1/12 87/6 |

FOREIGN PATENT DOCUMENTS

| | | |
|---|---|---|
| EP | 1582493 | 10/2005 |
| EP | 1586526 | 10/2005 |
| FR | 1599318 | 7/1970 |
| FR | 2576045 | 7/1986 |
| WO | 2004082724 | 9/2004 |
| WO | 2005019525 | 3/2005 |
| WO | 2006002439 | 1/2006 |
| WO | 2012162556 | 11/2012 |
| WO | 2013072941 | 5/2013 |
| WO | 2014110599 | 7/2014 |

OTHER PUBLICATIONS

First Office Action from The Australian Intellectual Property Office for Application No. 2014205084 dated Mar. 21, 2017 (8 pages).
EP14737687 Extended European Search Report dated Dec. 21, 2016 (14 pages).
McKenna et al., Hanbook of Fibre Rope Technology, handbook (2004) 10 pages, Woodhead Publishing Ltd., England.
Cortland, "Ship and Barge Mooring Lines," website (2012) 10 pages, www.cortlandcompany.com/products/synthetic-rope-and-strength-members/ship-and-bar.
First Office Action from The State Intellectual Property Office of the People's Republic of China for Application No. 201480012972.0 dated Jul. 22, 2016 ( 21 pages).
Office Action from the US Patent and Trademark Office for U.S. Appl. No. 14/155,317 dated Apr. 8, 2016 (6 pages).
Search Report from the International Searching Authority for International Application No. PCT/US2014/011545 dated May 20, 2014 (8 pages).
Written Opinion from the International Searching Authority for International Application No. PCT/US2014/011545 dated May 20, 2014 (7 pages).
PCT/US2015/026471 International Search Report and Written Opinion dated Jul. 24, 2015 (14 pages).

* cited by examiner

ROPE HAVING A LOW-FRICTION STRAND

RELATED APPLICATIONS

This application claims the benefit of prior-filed, U.S. Provisional Application No. 61/752,195, filed Jan. 14, 2013, the entire contents of which is hereby incorporated by reference.

FIELD

This invention generally relates to a reduced-wear synthetic fiber rope for various marine applications, particularly, a rope having a low-friction strand.

SUMMARY

Synthetic fiber ropes are used to carry tensile loads in various applications, such as working and lifting, towing, buoy mooring, tug and salvage operations, ship and barge mooring, commercial fishing, etc. The useful life of such ropes is limited due to wear of the individual fibers, which may be caused, to some extent, by the friction of the fibers rubbing against each other. The fibers rub against each other, for example, when a rope passes over a sheave or as the rope moves from a slack configuration to a configuration in which it carries a tensile load.

Prior attempts to alleviate friction and wear in the rope have included intertwining low-friction fibers with the high-friction fibers of the rope and adding lubricant or lubricating fibers to the rope. Such solutions may fail to achieve the desired reduction in friction and rope wear and may present independent shortcomings, for example, reduced rope performance (e.g., reduced friction in winching, splicing of the rope).

As such, a need exists for a rope with, for example, a longer useful life, improved performance, etc., compared to previous ropes. Such a rope may be subjected to less wear due to reduced friction between the rope's fibers while achieving acceptable performance in applications in which outer surface friction may be desired (e.g., winching, splicing, etc.).

In one independent aspect, a rope may generally include a plurality of primary strands each including a plurality of fibers formed of a high-friction material, the plurality of primary strands defining an outer surface and a longitudinal center passageway of the rope; and a non-load bearing secondary strand having a strand outer surface and disposed within the longitudinal center passageway of the rope, the secondary strand including, at least on the strand outer surface, a plurality of structurally stable fibers formed of a non-flowable, low-friction material.

In another independent aspect, a rope may generally include a plurality of outer strands together defining an outermost surface of the rope and a longitudinally-extending center passageway of the rope, each of the plurality of outer strands including a plurality of fibers formed of a high-friction material, the high-friction material defining a first coefficient of friction with itself; and a core strand disposed within the longitudinally-extending center passageway of the rope and separated from the outermost surface of the rope by at least one of the plurality of outer strands at all positions along a length and about a circumference of the rope, the core strand including a plurality of structurally stable fibers formed of a non-flowable, low-friction material, the non-flowable low-friction material defining a second coefficient of friction with the high-friction material, the second coefficient of friction being less than the first coefficient of friction.

In yet another independent aspect, a rope may generally include twelve outer strands together defining a longitudinally-extending center passageway of the rope, the twelve outer strands being braided in a single braid pattern, each of the twelve outer strands including twelve sub-strands braided in a single braid pattern, each of the sub-strands including a plurality of synthetic fibers; and a core strand disposed in the longitudinally-extending center passageway over the length of the rope, the core strand including a plurality of fibers.

In a further independent aspect, a method of constructing a rope may generally include providing a non-load bearing secondary strand having a strand outer surface, the secondary strand including, at least on the strand outer surface, a plurality of structurally stable fibers formed of a non-flowable, low-friction material; and surrounding the secondary strand with a plurality of primary strands each including a plurality of fibers formed of a high-friction material, the plurality of primary strands defining an outer surface and a longitudinal center passageway of the rope, the secondary strand being disposed within the passageway.

Independent features and independent advantages of the invention will become apparent to those skilled in the art upon review of the detailed description, drawings and claims.

DETAILED DESCRIPTION

Figure 1:
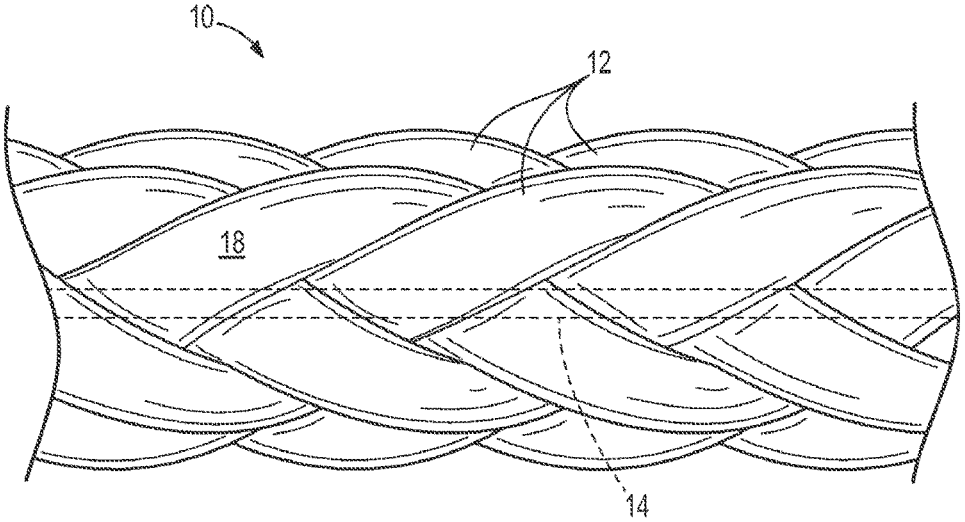
FIG. 1 is a side view of a rope having a low-friction strand, with the low-friction strand shown in phantom lines.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Referring to FIGS. 1-5, the illustrated rope 10 generally includes a high-friction, load bearing outer jacket or envelope (e.g., high-friction, load bearing outer strands 12 including high-friction fibers 16) surrounding a low-friction, non-load bearing core (e.g., a non-load bearing center strand 14 including structurally stable, non-flowable, low-friction fibers 22). As such, the rope 10 may provide one or more advantages associated with a high-friction outer jacket (e.g., acceptable surface coefficient of friction in applications in which outer surface friction may be desired (winching, splicing, etc.)), and with a low-friction core (e.g., reduced friction and wear on the load bearing strands 12 of the rope 10, as explained in greater detail herein). In other words, the illustrated rope 10 does not sacrifice rope performance to achieve reduced friction and wear.

In addition, because the illustrated low-friction material is separate from the outer strands 12, the low-friction material can be removed from the rope 10, as necessary. For example, the low-friction material can be removed at an end section of the rope 10 for splicing, for termination, etc. In such instances, the section of the rope 10 with the low-friction material removed will perform like a rope without any low-friction material.

It should be understood that the terms "high" and "low" are relative terms. For example, in the illustrated constructions, the outer strands 12 and fibers 16 have a higher coefficient of friction than the core strand 14 and fibers 22 which, in turn, have a lower coefficient of friction than the outer strands 12/fibers 16. Similarly, the outer strands 12 and fibers 16 may have a higher strength than the core strand 14 and fibers 22 which, in turn, have a lower strength than the outer strands 12/fibers 16.

The illustrated rope 10 includes a plurality of primary, load bearing strands 12 surrounding at least one auxiliary, non-load bearing strand 14. The illustrated center strand 14 is a low-friction strand (relative to the illustrated outer strands 12) to reduce the friction at the center of the rope 10, which is where most of the friction occurs. As such, the fibers of the rope 10 are subjected to relatively little wear as they rub against each other, resulting in, for example, an increased useful life compared to previous ropes.

Figure 2:
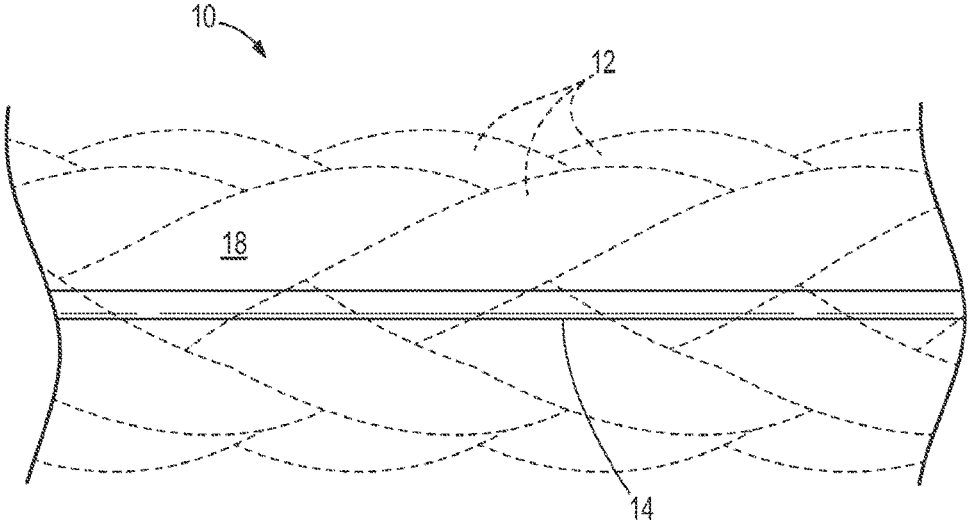
FIG. 2 is a side view of the rope of FIG. 1 with a plurality of outer strands shown in phantom lines.
Figure 3:
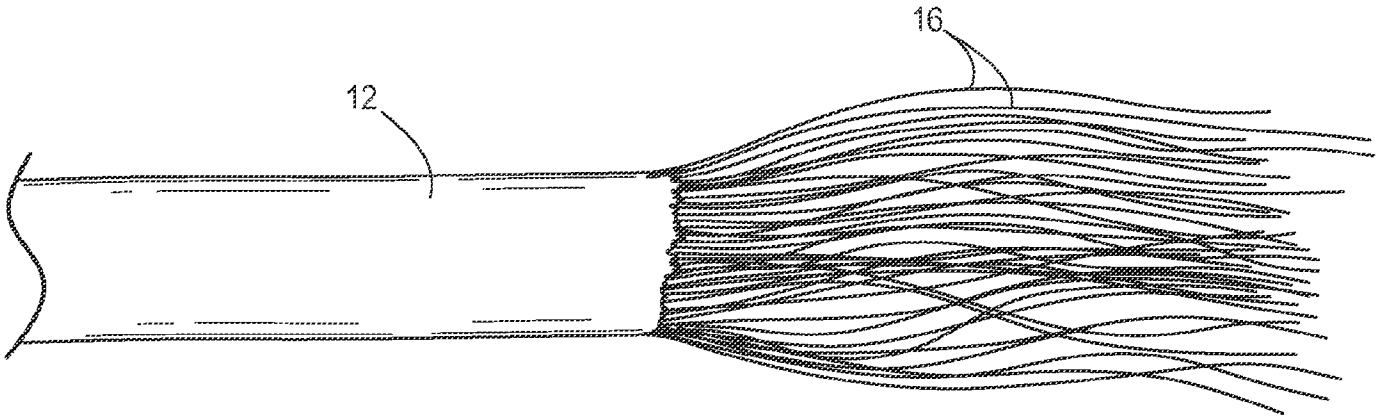
FIG. 3 is a side view of one of the outer strands of the rope of FIG. 1.

Turning to FIGS. 1-3, each outer strand 12 includes a plurality of fibers 16 formed of a high-friction material (that is, not a low-friction material, or a higher friction material relative to the center strand 14 and permitting the rope 10 to be driven by a pulley, sheave, etc.). The material of the fibers 16 is also high strength (e.g., having a higher strength than fibers 22). The outer strands 12 are thus high-strength, high-friction strands to provide a load bearing function and a high surface coefficient of friction for the rope 10.

The fibers 16 may comprise materials such as, without limitation, a recrystallized high modulus polyethylene (for example, Plasma®), a liquid crystal polyester (LCP; for example, Vectran® available from Kuraray Co., Japan), a gel-spun polyethylene (for example, Spectra® available from Honeywell International, Inc., New Jersey, U.S.A.), a para-aramid (for example, Kevler® available from DuPont, Delaware, U.S.A. or Twaron® available from Teijin Aramid B.V., The Netherlands), a para-aramid copolymer (for example, Technora® available from Teijin Aramid B.V.), a polyamide (nylon), a polyester, or the like or combinations thereof. The fibers 16 may have a polyurethane finish, although other finishes may alternatively be used.

In some constructions, one or more of the outer strands 12 may include composite strands formed of more than one material, such as more than one of the exemplary materials identified above. In some other constructions (e.g., in which the coefficient of friction of the rope surface is of less importance) and for other aspects of the invention, one or more of the outer strands 12 may include composite strands formed of both high- and low-friction materials. For example, the rope 10 may include a structure similar to that described in U.S. Pat. No. 6,945,153, entitled "Rope for Heavy Lifting Applications", the disclosure of which is also hereby incorporated by reference.

The plurality of outer strands 12 may be braided with one another. For example, the outer strands 12 may be braided in a "12×12" pattern like ropes provided by Cortland Cable of Cortland, N.Y. That is, there may be twelve outer strands 12 braided in a single braid pattern, and each of the twelve outer strands 12 may in turn include twelve sub-strands braided in a single braid pattern. The sub-strands may in turn include a plurality of synthetic fibers 16; each strand 12 may be braided with a center sub-strand formed of a low-friction material (e.g., fibers 22) in a manner similar to the construction of the illustrated rope 10. Similarly, the plurality of outer strands 12 may define a rope structure as described in U.S. Pat. No. 5,901,632, entitled "Rope Construction", the disclosure of which is hereby incorporated by reference.

The rope 10 and/or the plurality of outer strands 12 may alternatively be braided using other patterns (e.g., 12×3, 12×8, etc.) in which the rope or strand is braided with its core separated from its outer surface. In any case, the plurality of outer strands 12 define the outer surface 18 of the rope 10 and an inner longitudinally-extending passageway 20 in which the center strand 14 is disposed.

Figure 4:
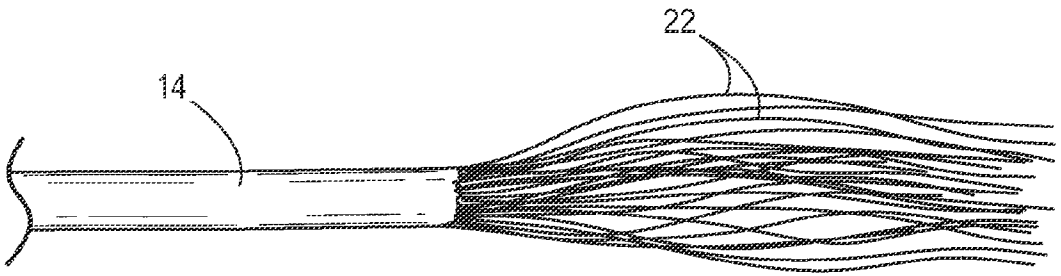
FIG. 4 is a side view of the low-friction strand of the rope of FIG. 1.
Figure 5:
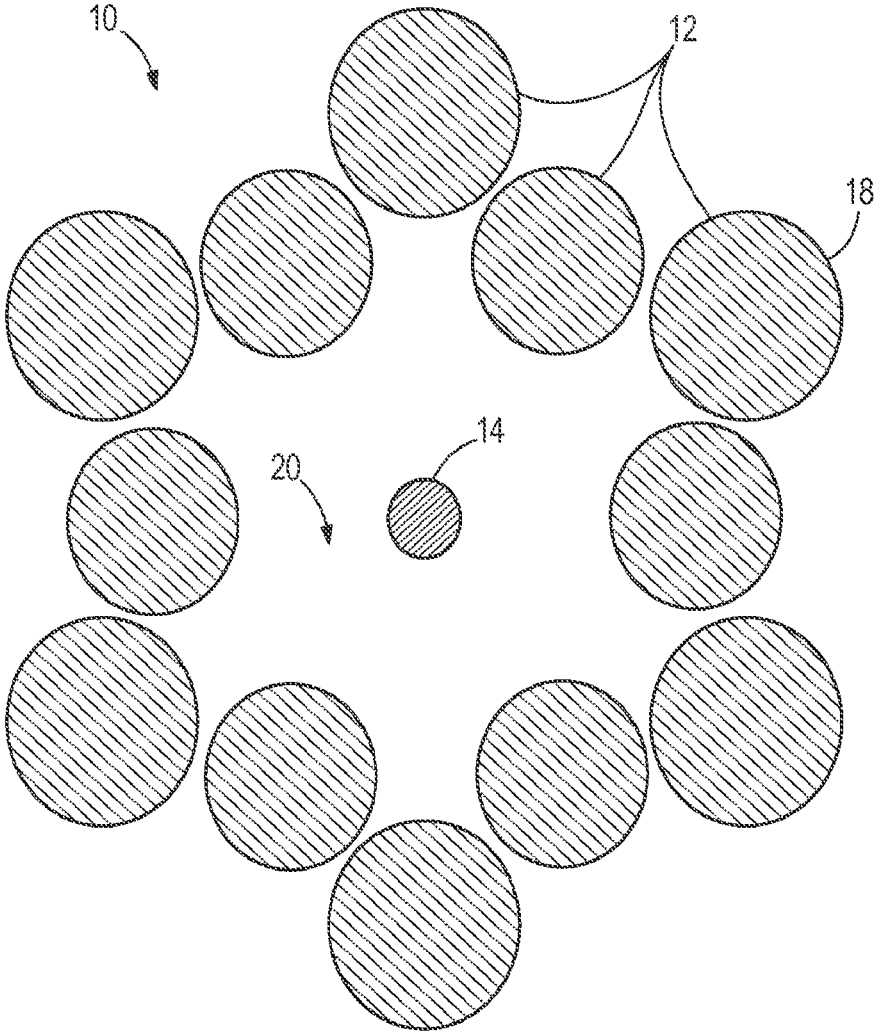
FIG. 5 is a cross-sectional view of the rope of FIG. 1, the space between the various strands is enlarged for clarity.

Turning to FIGS. 2, 4, and 5, the center strand 14 includes a plurality of non-flowable, structurally stable, and solid synthetic fibers 22 formed of a low-friction material (that is, a low-friction material with a coefficient of friction against the high-friction material lower than the coefficient of friction of the high-friction material against itself). In the illustrated construction, the material of the fibers 22 is also low strength (e.g., having a lower strength than the fibers 16). Thus, the illustrated core strand 14 is a low-strength (non-load bearing), low-friction strand providing reduced friction in the center of the rope 10 and, by being structurally-stable and non-flowable, does not impact the surface coefficient of friction of the rope 10.

The fibers 22 may comprise, for example, without limitation, ultra-high molecular weight polyethylene (UHMWPE)-based materials such as low-friction UHMWPE (for example, Dyneema® UHMWPE available from DSM N.V., The Netherlands, Spectra® 900 and Spectra® 1000 available from Honeywell International, Inc., or Endumax® available from Teijin Aramid B.V.), fluoropolymer-based materials such as expanded polytetrafluoroethylene (ePTFE; comprising non-flowable, stable, and solid fibers; for example, Omnibend® available from W. L. Gore & Associates, Inc., Delaware, U.S.A.), modified polytetrafluoroethylene, fluorinated ethylenepropylene (FEP), ethylene-chlorotrifluoroethylene (ECTFE), ethylene-tetrafluoroethylene (ETFE), a perfluoroalkoxy polymer (PFA), or the like or combinations thereof.

In one exemplary rope 10, the fibers 22 of the center strand 14 may comprise a fluoropolymer-based material (e.g., ePTFE), and the fibers 16 of the outer strands 12 may comprise a para-aramid copolymer (for example, Technora®). In another example, the fibers 22 may comprise a fluoropolymer-based material (e.g., ePTFE), and the fibers 16 may comprise UHMWPE.

The material of the fibers 22 is structurally stable and non-flowable, meaning that it stays positioned in the passageway 20 and does not flow, creep or get squeezed out between the outer strands 12 to the outside of the rope 10. The fibers 22 may be braided, twisted, etc.

The fibers 22 and the center strand 14 are disposed in the passageway 20 defined by the outer strands 12 over the entire length of the rope 10. Furthermore, the center strand 14 is separated from the outer surface 18 by at least one of the outer strands 12 at all points along the entire length and about the entire circumference of the rope 10. As such, the center strand 14 reduces the friction at the center of the rope 10, and the fibers 16, 22 are subjected to relatively little wear as they rub against each other.

The diameter of the center strand 14 (or the largest cross-sectional dimension if the strands 12 are compressed against one another) is such that the center strand 14 does not adversely affect the performance of the outer stands 12 and the rope 10 (e.g., does not interfere with the load-carrying capabilities of the outer strands 12). As a practical example, a center strand 14 that is at most one-third of the diameter of each of the outer strands 12 (or the largest cross-sectional dimension) will generally not affect the performance or the outer diameter of a given rope 10. However, it should be understood that the center strand 14 may be smaller or larger (even as large as or larger than the outer strands 12).

In some constructions, the center strand 14 may be formed of a low-friction, high-strength material. In some constructions, the center strand 14 may include a composite strand formed of more than one material, such as more than one of the exemplary materials identified above. In some constructions (not shown), the rope 10 may include more than one center strand 14.

Figure 6:
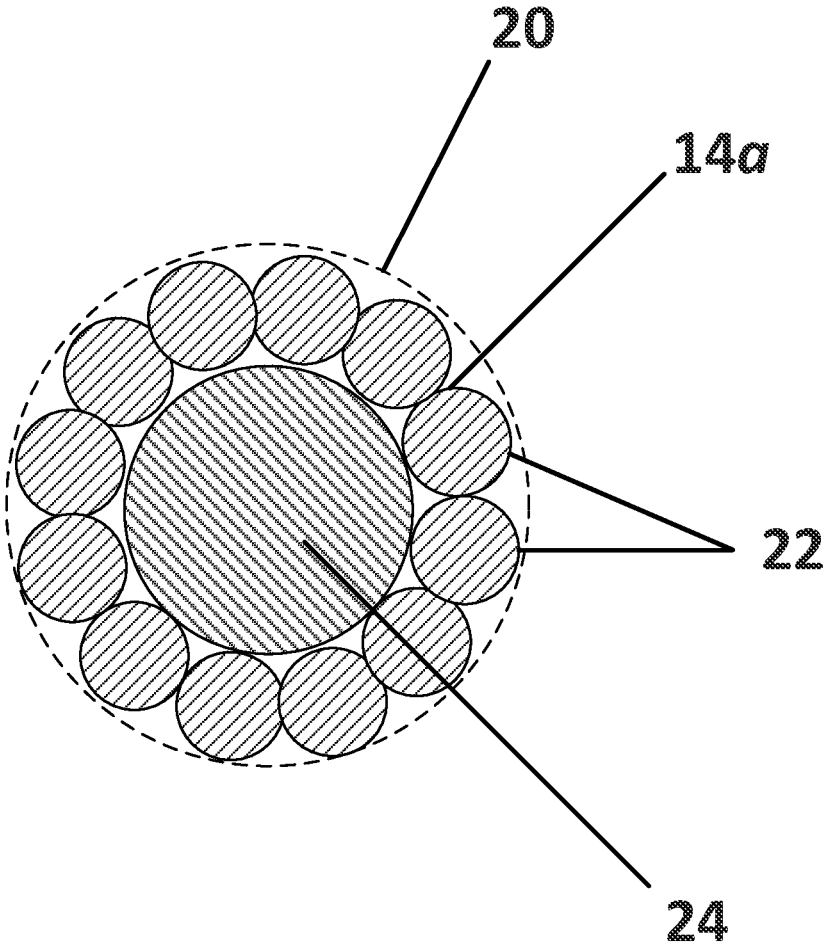
FIG. 6 is a cross-sectional view of an alternative construction of a center strand.

In some other constructions (see FIG. 6) and for other aspects of the invention, the center strand 14*a* may include a hybrid strand formed of one or more of the exemplary low-friction materials identified above in combination with other materials In such constructions, the center strand 14*a* may include a non-load bearing center or core element 24, formed of a material having a relatively higher coefficient of friction than the low-friction material. The core element 24 is surrounded by a low-friction material (e.g., fibers 22), with the low-friction material being between the inner surface of the outer strands 12 and the core element 24 at all points along the entire length and about the entire circumference of the passageway 20.

The core element 24 may be braided. To surround the core element 24, the low-friction material (e.g., fibers 22) may, for example, form a braided jacket or be twisted around the core element 24 to define the low-friction strand 14*a*.

The core element 24 may comprise, for example, without limitation, a multi-filament polyester (available from Kuraray, Co., Japan; Teijin Limited, Japan; or Unifi, Inc., North Carolina, U.S.A.), a para-aramid copolymer (for example, Technora® available from Teijin Aramid B.V.), a liquid crystal polyester (LCP; for example, Vectran® available from Kuraray Co., Japan), a polyamide, a polyester, or the like or combinations thereof.

Such a hybrid center strand construction may be used in larger ropes (e.g., having a diameter of 3⅝" or greater or a circumference of 80 mm or greater) in which a larger passageway 20 can be formed. Relatively-expensive low-friction material can be used with less expensive material of the core element 24 to form a larger center strand 14*a* to occupy the larger passageway 20.

Figure 7:
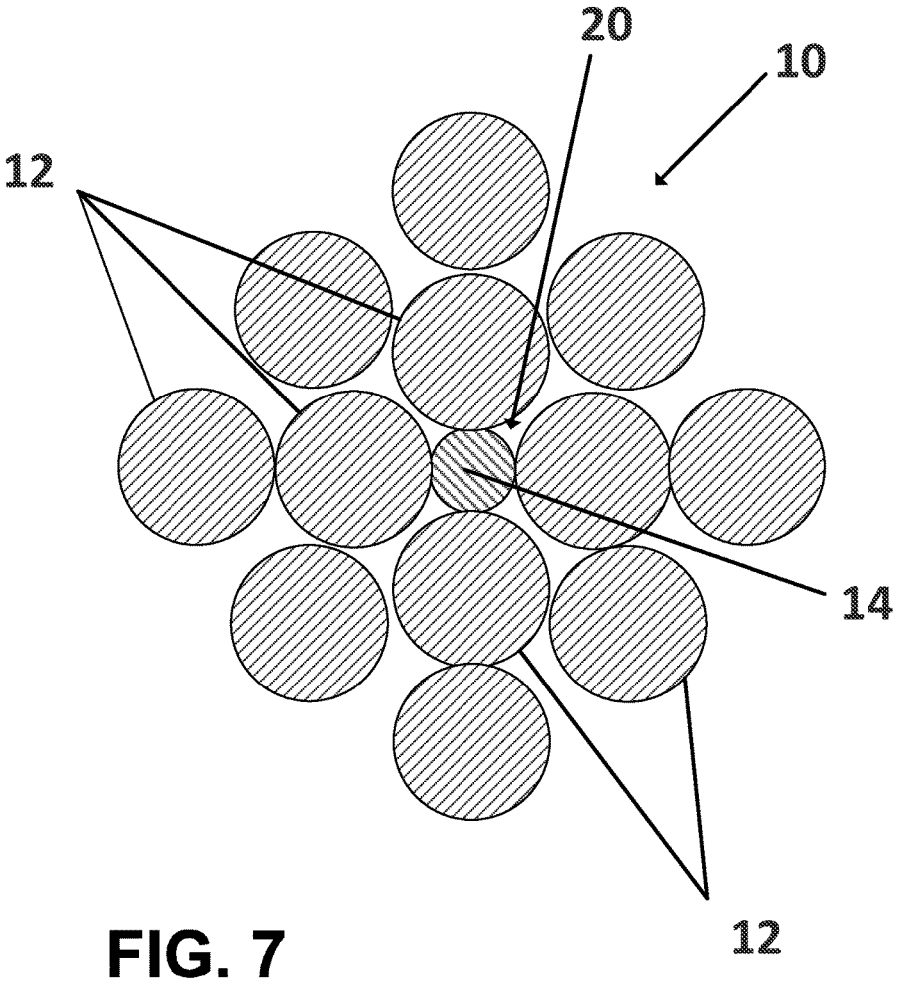
FIG. 7 is a schematic cross-sectional view illustrating use of the rope and engagement of outer strands with the low-friction strand.

When the rope 10 is used, all strands 12, 14 move relative to each other. As the rope 10 is used and tension added (see FIG. 7), the "void" area in the center passageway 20 disappears, and the center strand 14 is in contact with the outer strands 12. The low-friction strand 14 keeps the outer strands 12 from contacting each other at the center and allows the outer strands 12 to move against a low-friction material (e.g., fibers 22) that will not cause damage to the strands 12.

From the above description, it should be apparent that the present invention provides a rope that may include a structurally stable, non-flowable, low-friction center strand to reduce the friction at the center of the rope while maintaining the coefficient of friction of the rope surface. As such, the fibers of the rope may be subjected to reduced wear as they rub against each other, resulting in increased useful life and improved performance compared to previous ropes.

One or more independent features and independent advantages of the invention may be set forth in the following claims:

What is claimed is:

1. A rope comprising:

a plurality of primary strands each including a plurality of fibers formed of a high-friction material, the plurality of primary strands defining an outer surface and a longitudinal center passageway of the rope; and a non-load bearing secondary strand having a strand outer surface and disposed within the longitudinal center passageway of the rope, the secondary strand including, at least on the strand outer surface, a plurality of structurally stable fibers formed of a non-flowable, low-friction material, wherein when the rope is not under tension, the secondary strand resides in a void defined by the center passageway of the rope, and wherein, when the rope is under tension, the plurality of primary stands move relative to each other to eliminate the void and contact the secondary strand, whereby the secondary strand prevents the primary strands from contacting each other at the center passageway, wherein the secondary strand has a diameter that is less than a diameter of each of the primary strands, wherein the diameter of the secondary strand is no more than one-third the diameter of the primary strands.

2. The rope of claim 1, wherein the low-friction material is configured to remain in the longitudinal center passageway of the rope and not creep or flow to the outer surface of the rope.

3. The rope of claim 1, wherein the secondary strand is separated from the outer surface of the rope by at least one of the plurality of primary strands at all positions along a length and about a circumference of the rope.

4. The rope of claim 1, wherein the low-friction material includes one of low-friction ultrahigh molecular weight polyethylene, expanded polytetrafluoroethylene, modified polytetrafluoroethylene, fluorinated ethylenepropylene, ethylene-chlorotrifluoroethylene, ethylene-tetrafluoroethylene, a perfluoroalkoxy polymer or combinations thereof.

5. The rope of claim 1, wherein the high-friction material is also a load bearing material.

6. The rope of claim 1, wherein the plurality of primary strands forms a braid around the secondary strand.

7. The rope of claim 1, wherein the entire secondary strand is formed of the non-flowable, low-friction material.

8. The rope of claim 1, wherein the secondary strand includes a non-load bearing core element surrounded by the plurality of structurally stable fibers formed of non-flowable, low-friction material.

9. The rope of claim 1, wherein each of the primary strands are free of low-friction fibers.

10. A rope comprising:

a plurality of outer strands each including a plurality of fibers formed of a high-friction material, the plurality of outer strands defining an outer surface and a longitudinal center passageway of the rope; and a core strand disposed within the longitudinal center passageway of the rope, the core strand including, at least on the strand outer surface, a plurality of fibers formed of a low-friction material, wherein the core strand has a diameter smaller than the passageway while the rope is not under tension, allowing the outer strands to move relative to each other and compress against the core strand when the rope is under tension.

11. The rope of claim 10, wherein the high-friction material defines a first coefficient of friction with itself, and wherein the plurality of fibers of the core strand include a low-friction material, the low-friction material defining a second coefficient of friction with the high-friction material less than the first coefficient of friction.

12. The rope of claim 10, wherein the high-friction material is a load bearing material.

13. The rope of claim 12, wherein the low-friction material is a non-load bearing material.

14. The rope of claim 10, wherein the plurality fibers of the core strand include a non-flowable, low-friction material.

15. The rope of claim 10, wherein the entire core strand is formed of the non-flowable, low-friction material.

16. The rope of claim 10, where the core strand includes a non-load bearing core element surrounded by the plurality of fibers formed of low-friction material.

17. The rope of claim 10, wherein the core strand has a diameter that is less than a diameter of each of the outer strands.

18. A rope comprising:

a plurality of outer strands each including a plurality of fibers formed of a high-friction material, the plurality of outer strands defining an outer surface and a longitudinal center passageway of the rope; and a core strand disposed within the longitudinal center passageway of the rope, the core strand including, at least on the strand outer surface, a plurality of fibers formed of a low-friction material, wherein the core strand has a diameter smaller than the passageway while the rope is not under tension, allowing the outer strands to move relative to each other and compress against the core strand when the rope is under tension, wherein the core strand has a diameter that is less than a diameter of each of the outer strands, wherein the diameter of the core strand is no more than one-third the diameter of the outer strands.

19. A method of constructing a rope, the method comprising:

providing a non-load bearing secondary strand having a strand outer surface, the secondary strand including, at least on the strand outer surface, a plurality of structurally stable fibers formed of a non-flowable, low-friction material; and surrounding the secondary strand with a plurality of primary strands each including a plurality of fibers formed of a high-friction material, the plurality of primary strands defining an outer surface and a longitudinal center passageway of the rope, the secondary strand being disposed within the passageway and dimensioned to allow movement of the primary strands relative to each other and compress the rope when in use and under load wherein the secondary strand has a diameter that is less than a diameter of each of the primary strands, wherein the diameter of the secondary strand is no more than one-third the diameter of the primary strands.

20. The method of claim 19, wherein the low-friction material is configured to remain in the longitudinal center passageway of the rope and not creep or flow to the outer surface of the rope.

* * * * *